US008965014B2

(12) United States Patent
Castor-Perry

(10) Patent No.: US 8,965,014 B2
(45) Date of Patent: Feb. 24, 2015

(54) ADAPTING AUDIO SIGNALS TO A CHANGE IN DEVICE ORIENTATION

(75) Inventor: Kendall Castor-Perry, San Diego, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 546 days.

(21) Appl. No.: 13/213,430

(22) Filed: Aug. 19, 2011

(65) Prior Publication Data

US 2012/0051567 A1 Mar. 1, 2012

Related U.S. Application Data

(60) Provisional application No. 61/378,639, filed on Aug. 31, 2010.

(51) Int. Cl.

| | |
|---|---|
| ***H04R 5/02*** | (2006.01) |
| ***H04R 29/00*** | (2006.01) |
| ***H04S 7/00*** | (2006.01) |

(52) U.S. Cl.

CPC ..... *H04R 29/002* (2013.01); *H04S 7/30* (2013.01); *H04R 2201/028* (2013.01); *H04R 2205/022* (2013.01); *H04R 2420/03* (2013.01); *H04R 2499/11* (2013.01); *H04S 2400/07* (2013.01); *H04S 2400/13* (2013.01)

USPC ..... 381/304; 381/81; 381/333; 381/334

(58) Field of Classification Search

USPC ..... 381/84, 304

See application file for complete search history.

(56) References Cited

U.S. PATENT DOCUMENTS

| | | | | |
|---|---|---|---|---|
| 5,440,639 | A | 8/1995 | Suzuki | |
| 6,243,476 | B1 | 6/2001 | Gardner | |
| 2001/0011993 | A1 | 8/2001 | Saarinen | |
| 2004/0228498 | A1 | 11/2004 | Sekine | |
| 2004/0247132 | A1 | 12/2004 | Klayman et al. | |
| 2006/0093158 | A1 | 5/2006 | Noro | |
| 2006/0161278 | A1 | 7/2006 | Maeda | |
| 2009/0279721 | A1 | 11/2009 | Tanaka | |
| 2011/0002487 | A1* | 1/2011 | Panther et al. | 381/300 |
| 2012/0207328 | A1* | 8/2012 | Anderson | 381/103 |

OTHER PUBLICATIONS

Written Opinion of the International Searching Authority dated Dec. 19, 2011 for International Application No. PCT/US2011/049917; 11 pages.

International Search Report of the International Searching Authority dated Dec. 19, 2011 for International Application No. PCT/US2011/049917; 3 pages.

* cited by examiner

*Primary Examiner* — Joseph Saunders, Jr.
*Assistant Examiner* — James Mooney

(57) ABSTRACT

Left and right stereo channels L and R are provided to a first set of two or more speakers of a speaker array. A bass signal B is applied to a second set of one or more speakers of the speaker array. The level of L and R applied to the first set of speakers is increased as the first set of speakers is rotated to become more horizontally aligned. The level of B applied to the first set of speakers is decreased as the first set of speakers is rotated to become more horizontally aligned.

21 Claims, 6 Drawing Sheets

A

B

ADAPTING AUDIO SIGNALS TO A CHANGE IN DEVICE ORIENTATION

PRIORITY CLAIM

This application claims priority under 35 U.S.C. 119 to U.S. provisional application No. 61/378,639 filed on Aug. 31, 2010, which is incorporated herein by reference in its entirety.

BACKGROUND

Conventional stereo uses two speakers that can be conceptualized as being at either end of an imaginary horizontal rod. Conventional stereo reproduces a sound field created by sound sources arranged in the horizontal plane. If the 'rod' is rotated by 90 degrees so that the speakers are now vertically aligned, the arrangement has no left/right discrimination, only up/down discrimination. In general, any rotation of the two stereo speakers from pure horizontal can adversely affect horizontal discrimination in the perceived sound field.

BRIEF DESCRIPTION OF THE DRAWINGS

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

DETAILED DESCRIPTION

Preliminaries

Figure 1:
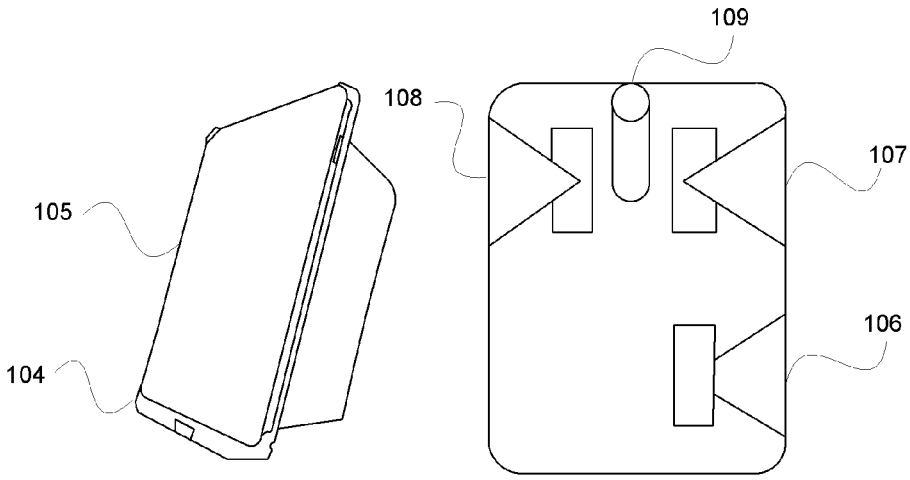
FIG. 1 illustrates a portable audio device having a display and a speaker array.
Figure 1:
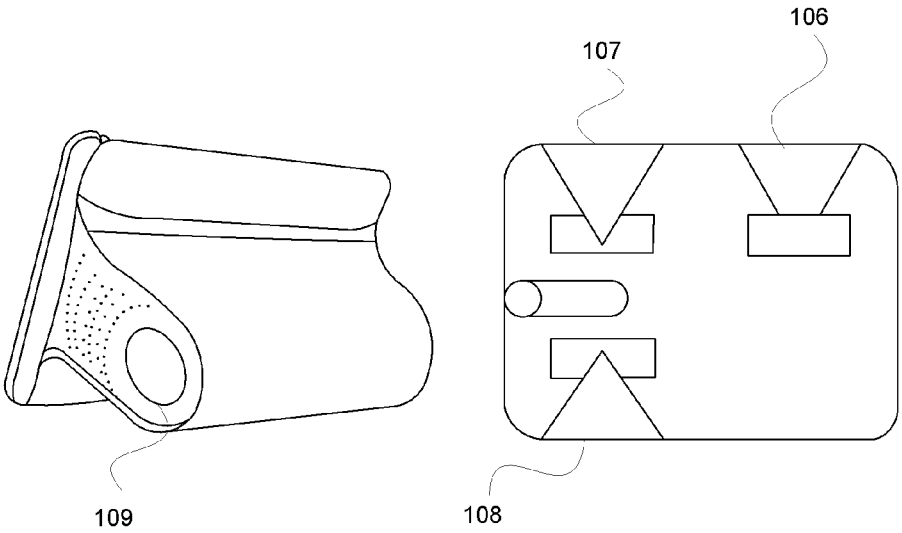

References to "one embodiment" or "an embodiment" do not necessarily refer to the same embodiment, although they may. Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively, unless expressly limited to a single one or multiple ones. Additionally, the words "herein," "above," "below" and words of similar import, when used in this application, refer to this application as a whole and not to any particular portions of this application. When the claims use the word "or" in reference to a list of two or more items, that word covers all of the following interpretations of the word: any of the items in the list, all of the items in the list and any combination of the items in the list, unless expressly limited to one or the other.

"Logic" refers to machine memory circuits, machine readable media, and/or circuitry which by way of its material and/or material-energy configuration comprises control and/or procedural signals, and/or settings and values (such as resistance, impedance, capacitance, inductance, current/voltage ratings, etc.), that may be applied to influence the operation of a device. Magnetic media, electronic circuits, electrical and optical memory (both volatile and nonvolatile), and firmware are examples of logic.

Those skilled in the art will appreciate that logic may be distributed throughout one or more devices, and/or may be comprised of combinations memory, media, processing circuits and controllers, other circuits, and so on. Therefore, in the interest of clarity and correctness logic may not always be distinctly illustrated in drawings of devices and systems, although it is inherently present therein.

The techniques and procedures described herein may be implemented via logic distributed in one or more computing devices. The particular distribution and choice of logic is a design decision that will vary according to implementation.

The term "speaker array" as used herein means any arrangement of speakers in physical space. Various examples are provided including three speakers and four speakers which are all substantially coplanar. However, the techniques and circuits described herein are more generally applicable.

The term "low frequency signal" or "bass signal" has its conventional meaning in the art of audio system design. The exact range of what constitutes a "low frequency signal" or "bass signal" may vary according to the intended application, acoustic parameters, and so forth.

The term "horizontally aligned" in regards to speakers in a speaker array means an alignment, consistent with the audio environment and/or audience, that produces a horizontal stereo effect as that term is understood in the audio arts.

The term "continuous adjustment" as applied to signals means multiple adjustments over the course of a relevant interval, where the interval can be a time interval, a rotation interval, or whatever interval is appropriate to the context.

The term "full range speakers" has its normal meaning in the audio arts, e.g. speakers capable of accurately and with ample output power producing sound over substantially all of the range of hearing of the audience (including bass sound).

Overview

A device may include an array of three or more speakers. A low frequency bass signal B is derived from left and right stereo signal channels L and R, respectively. The L and R signals may originate from a digital audio file stored by the device, from an audio stream received via a network connection, from audio associated with video signals, or a number of other sources readily apparent to those skilled in the art. The signals L and R may be filtered in known ways to obtain the signal B and in some cases to also reduce the low frequency content of L and R themselves.

The speaker array, or an associated display device (such as a television, iPad™, music player, or other display surface, may be rotated in space. The level of signal B to certain speakers of the array may be increased, and the level of L or R to those same speakers decreased, as a function of the angle of rotation. In particular, as a particular speaker becomes less horizontally aligned with other speakers of the array due to rotation of the device, the level of B to that speaker may be increased and the levels of L and R to that speaker decreased. Likewise, the level of L and R to the speakers becoming more horizontally aligned may be increased, and the level of B to those speakers decreased, throughout the rotation interval.

In some implementations, though not all, each speaker of the array may be a full range speaker, and the signal B is applied to every speaker (e.g., by adding B to the signal applied to each speaker) of the array regardless of the orientation of the device, improving the overall bass signal reproduction of the array. Certain implementations include exactly three speakers driven by four amplifiers. In one specific case involving four amplifiers and three speakers, four amplifiers are coupled to exactly two speakers apiece, and a different two of the four amplifiers are coupled to exactly one speaker apiece.

The device itself may be a visual display coupled to the speaker array via a docking platform, configured so that the display rotates and the speaker array remains in a fixed orientation with respect to the display, and the horizontal alignment of various speakers in the array is a virtual property determined from the rotational angle of the visual display.

In practice, it may not be possible to accurately determine a degree of rotation of the speaker array (or associated display surface). However, it may be possible to determine that the device has begun the process of being rotated. In such cases, a parameter representing the degree of rotation according to an elapsed time from when a beginning of rotation of the surface is first detected may be used to adjust the signals to the speakers. In some devices, the mapping of L, R, and B to various speakers in the array, as well as any filtering applied to L and R (e.g. to produce B), may be carried out in a digital oversampled domain.

While some implementations will employ an external power amplifier circuit (i.e. the amplifiers are implemented in a separate chip package from the mapping logic), others may integrate the signal processing and amplification into PSOC (Programmable System on a Chip) devices.

Exemplary Implementation

Referring to FIG. 1, an array of three or more speakers 106-108 may be rotated around an axis predominantly perpendicular to a plane through the speakers, for example when a portable audio device 104 with a display 105 (e.g. an iPod™ or an iPad™) is rotated ninety degrees counterclockwise. Consistently horizontal stereo sound may be produced for continuous degrees of rotation around said axis, or in a small number of specific orientations imposed by the surroundings and/or the mounting mechanism, e.g. built in rotational stops. The speaker array may be mounted in a product such as a television, monitor, or display docking device, to provide just a few examples.

The device may be designed so that all the speakers are capable of reproducing a full range of audio, but in practice some speakers may be used as full range units and some as bass units, or combinations thereof, with the roles of the units changing as a function of the rotational orientation. The speakers may all share the same acoustical housing, which may include a reflex port 109, and therefore may be acoustically coupled at low frequencies.

The mapping of the two input channels (L and R stereo channels) to the four speaker outputs depends on the orientation of the speaker array. As the array is rotated, the mapping functions are adjusted. For example, the right-hand speaker in some orientations is provided with the left-hand output in some orientations. Mapping is continuously adjusted across different intermediate orientations, so that reproduction isn't disrupted when and while the unit is rotated. Sound orientation may be synchronized with picture orientation by using, for example, inter-application communication (an application being a logic-driven process executing on the rotated device).

On some audio devices and docking configurations, such as iPods, the speakers project sound primarily along the plane of the device surface, not forward toward the listener. This configuration causes difficulty achieving good sound quality in the landscape mode, in which the speakers may project sound almost vertically up and down. This makes it difficult to achieve controlled high frequency energy in either the direct or reflected sound at the listening position.

One approach to this problem uses slot loading for the speakers. The speakers project sound into a small chamber with a narrow exit slot that gives good dispersion in the plane perpendicular to the slot. The slots wrap round the corners of the dock to provide good forward projection and wide stereo dispersion of sound in either orientation. One embodiment employs only three slot loaded speakers, not four, coupled to four amplifiers, as further described.

Bass Power Handling

A bass signal B may be produced by low pass filtering, and then averaging, the left and right stereo channels L and R. The level of signal B applied to certain speakers of the array may be increased, and the level of L or R to those same speakers decreased, as a function of the angle of rotation. In particular, as a particular speaker becomes less horizontally aligned with other speakers of the array due to rotation of the device, the level of B to that speaker may be increased and the levels of L and R to that speaker decreased. Likewise, the level of L and R to the speakers may be increased as the speakers become more horizontally aligned, and the level of B to those speakers decreased, throughout the rotation interval.

Certain embodiments may employ only three speakers, driven by four amplifiers, to save cost, space, and weight. Maximum bass power may be achieved when all three speakers are reproducing the same low frequency signal with the same gain. Equalization may be employed to return the frequency response to a target value determined by the system 'voicing' (i.e. the desired tonal balance).

A novel approach employs three speakers coupled to four amplifiers. None of the speakers is grounded. Potentially, the double drive voltage available from a bridged amplifier configuration may be provided to all speakers in the array. This configuration does not suffer from single-ended amplifier's poor power supply rejection, because a fluctuation in the power supply voltage causes all the speaker outputs to fluctuate by the same amount.

Figure 2:
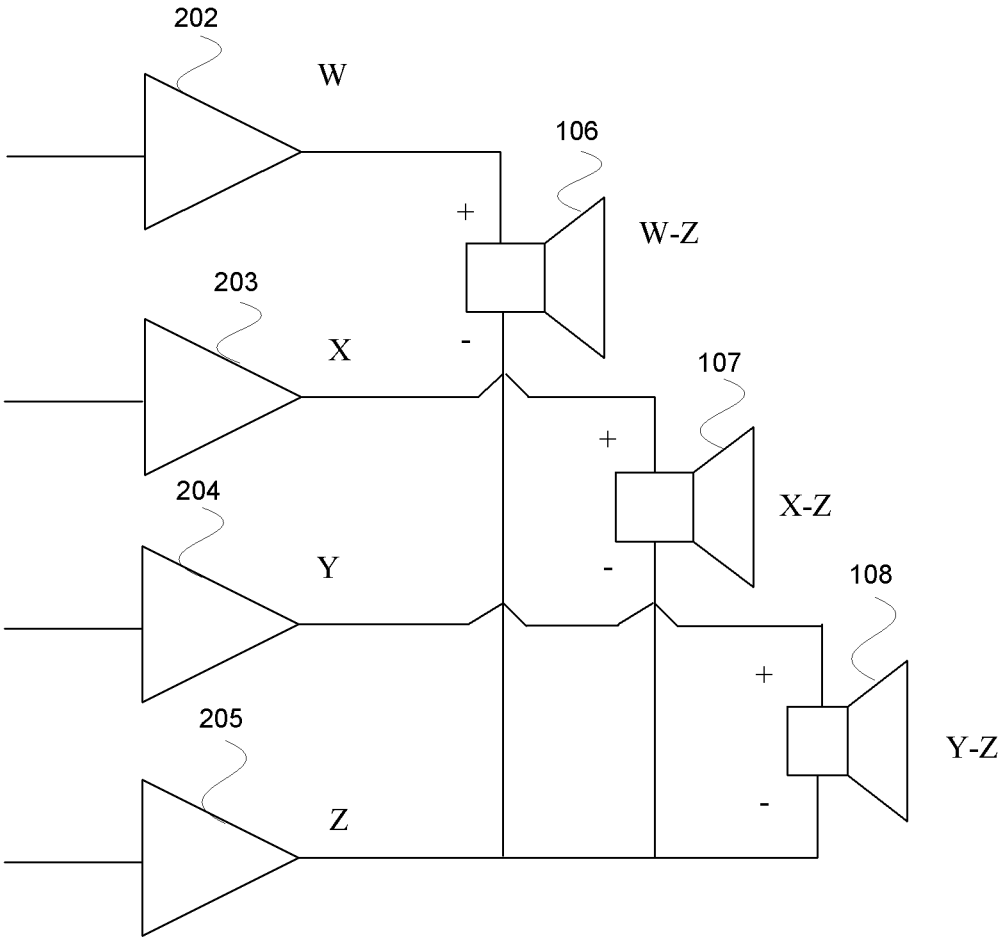
FIGS. 2-4 illustrate embodiments of configurations of amplifiers and speakers.

The configuration illustrated in FIG. 2 is, with correct speaker connection phasing, an effective solution for a three speaker single orientation design. However it is less ideal for speaker systems that are rotated or which simulate rotation. In this design, four amplifiers 102-105 produce output signals W, X, Y, and Z to drive three speakers 106-108. The speakers output audio signals that represent the difference of their respective input signals: W-Z, X-Z, an Y-Z.

Figure 3:
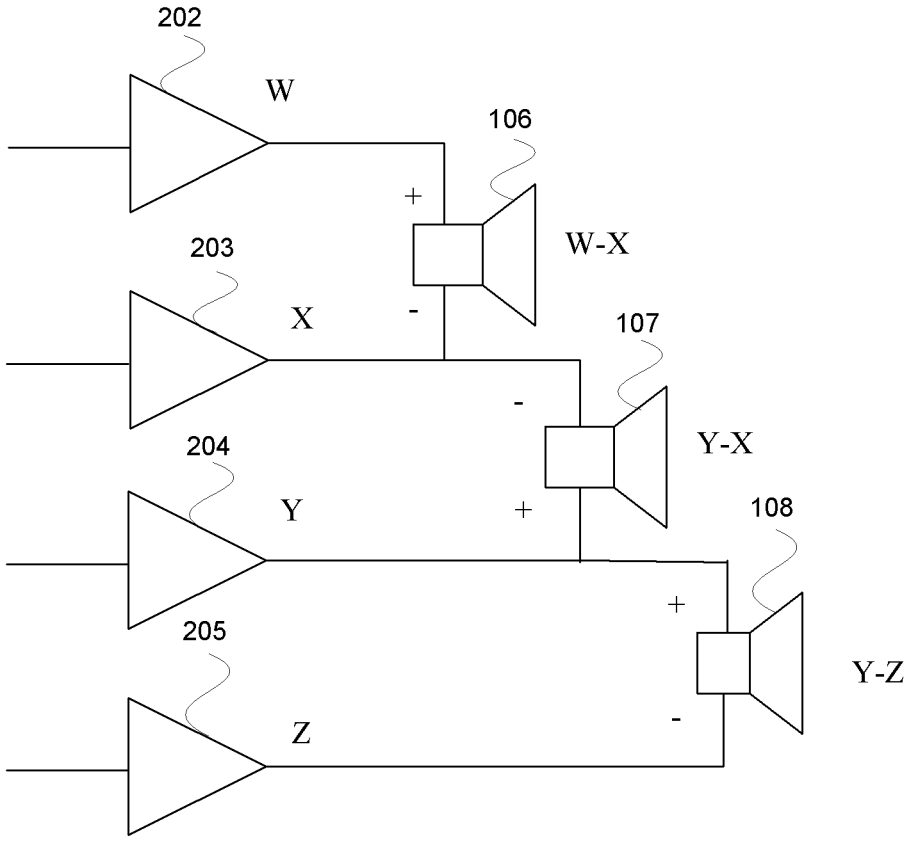

The configuration in FIG. 3 is more suited to rotated audio. Two of the amplifier channels (X and Y) supply signals to two of the speakers. The other two amplifier channels (W and Z) supply signals to just one speaker each. Amplifiers X and Y have to deliver nominally twice the current of amplifiers W and Z. They are effectively loaded with half the impedance. Note this is not a conventional amplifier bridge configuration.

Figure 4:
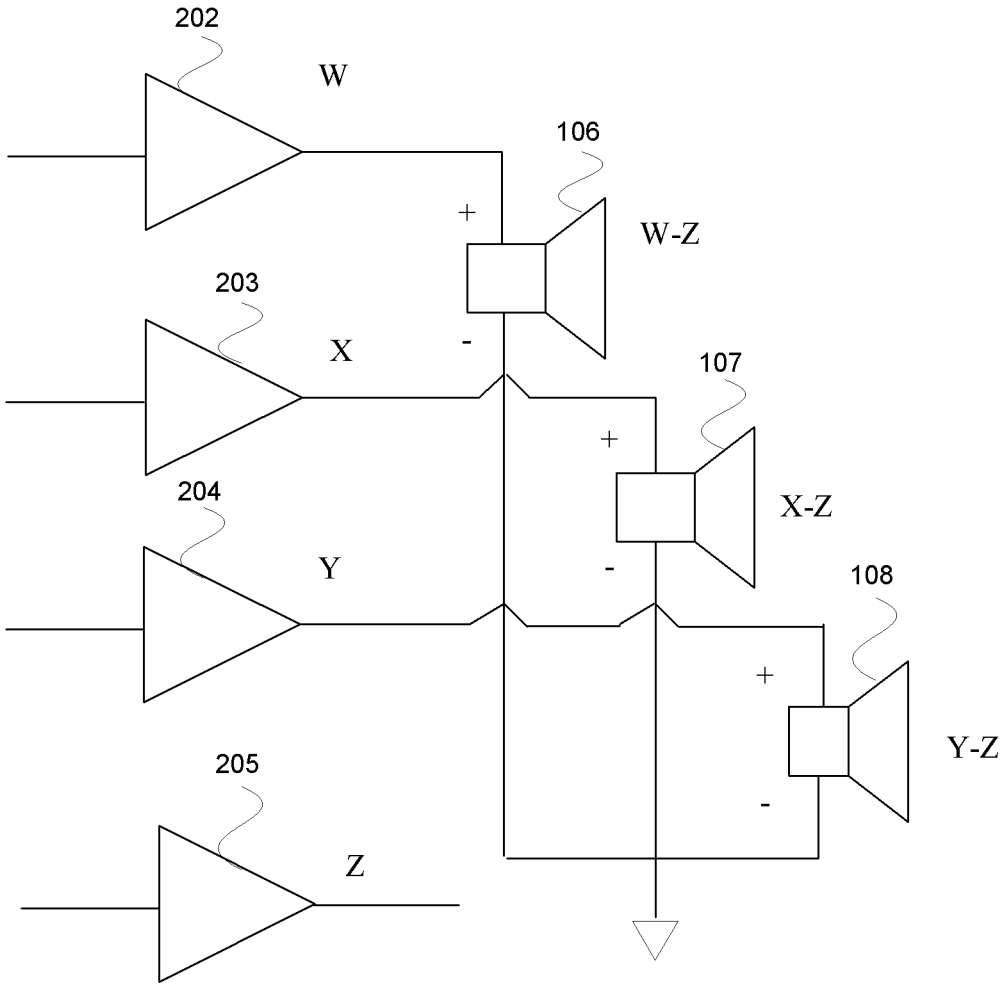

The configuration in FIG. 4 employs three speakers driven by three amplifiers. Each speaker is driven by a single amplifier and is grounded. All the speakers in such a system may be driven by amplifiers with the same voltage output capabilities. If the amplifiers are simple open-loop digital amplifiers, this single-ended arrangement requires a high quality power supply in order to not suffer from poor power supply rejection behavior. An efficient use may be found for a fourth amplifier (many chip packages are preconfigured with four amplifiers). For example, in some cases the array may include a fourth full range speaker that is selectively coupled to a bass signal depending on the array orientation, or which contributes to the output of L and R according to said rotation.

Figure 5:
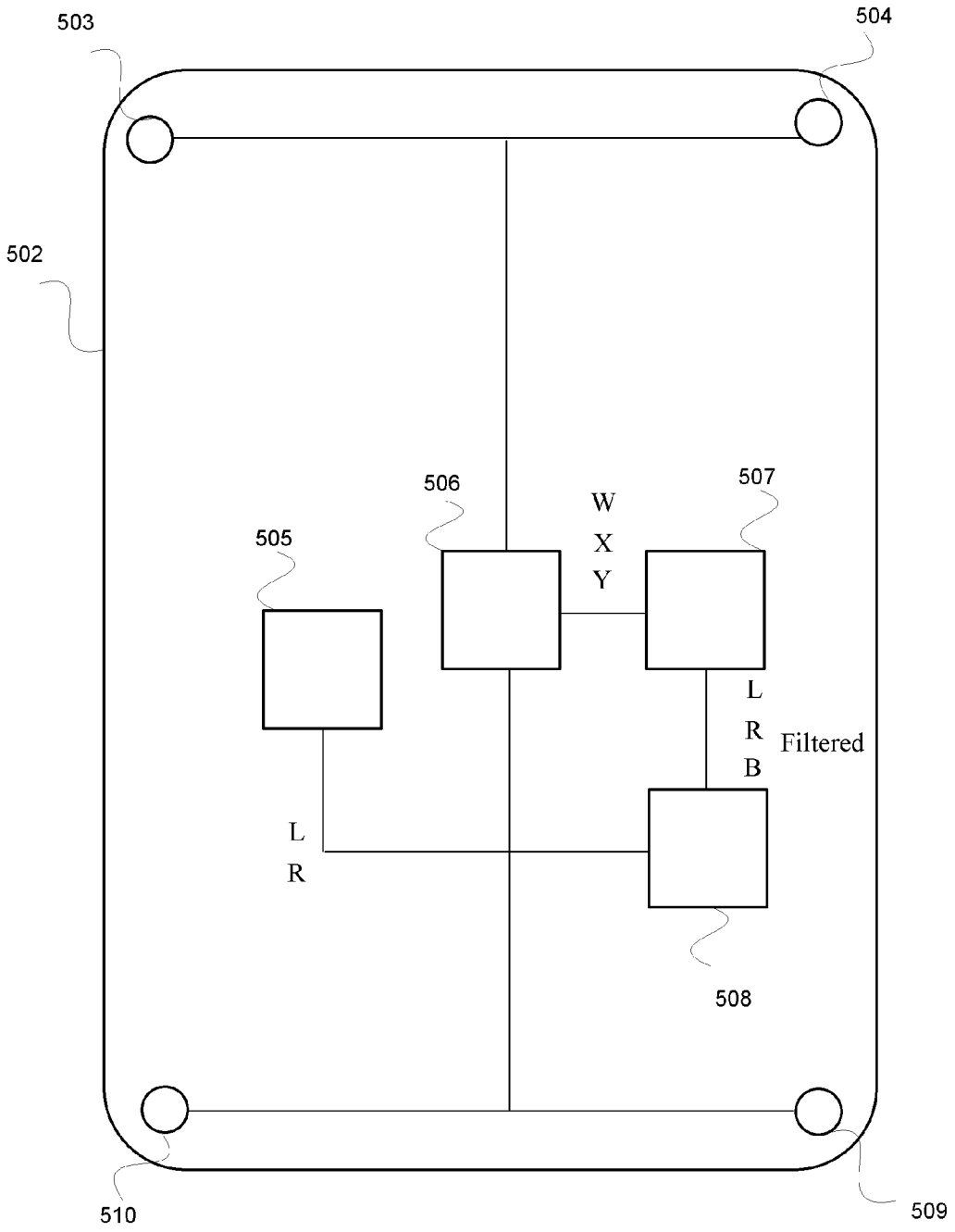
FIG. 5 illustrates a device incorporating logic to adjust speaker outputs according to an angle of rotation of the device.

An example of an overall device implementing rotating stereo sound is illustrated in FIG. 5. Four speakers 503, 504, 509, and 510 are positioned along the sides of the device 502, near the corners. A similar device employing only three speakers may employ a pair of speakers along one edge, and another pair of speakers (with one speaker in common with the first pair) along a second edge. See for example FIG. 1.

The device may include logic 505 to act as a source of stereo audio. This audio source 505 may be an audio file, an audio/video file, a network connection, and so on as is well known in the art. The audio source may provide signals L and R to filter logic 508. The filter logic 508 may purify L and R of low frequency components, may filter L and R to generate B, and may perform other processing on these signals, such as is known in the art. The signals L, R, and B may be applied to mapping logic 507. Signals W, X, and Y (and also possibly channels Z and beyond, depending on the number of amplifiers employed) are generated from L, R, and B by mapping logic 506, depending upon an orientation of the device, or upon an elapsed time after rotation of the device is determined to have commenced. The amplifier outputs are used (either single ended or differentially, see FIGS. 2-4) to drive the speakers 503, 504, 509, 510.

Figure 6:
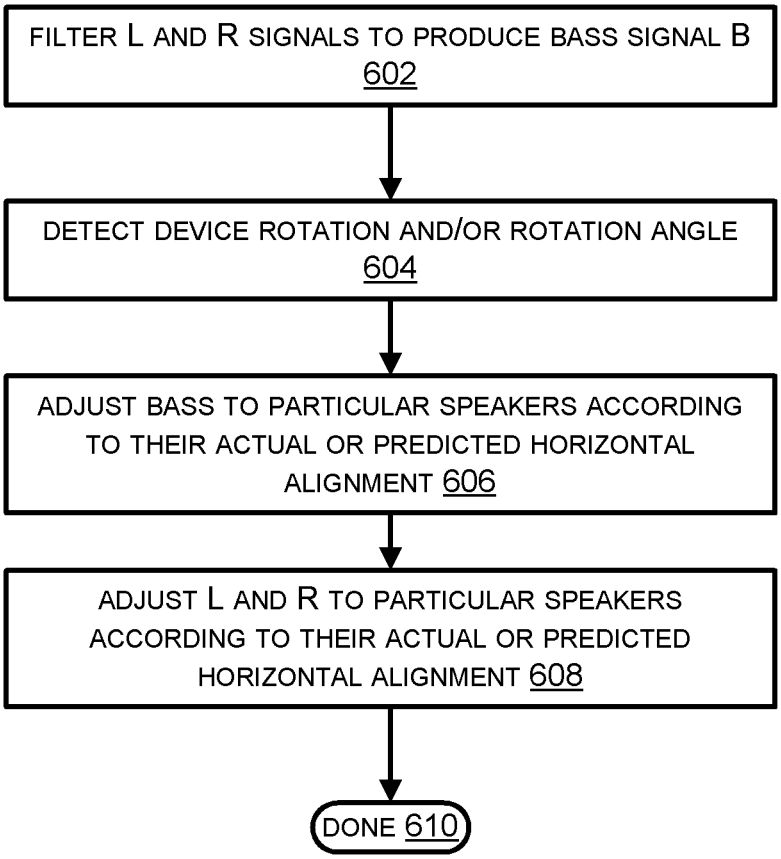
FIG. 6 illustrates a process of adjusting speaker outputs according to an angle of rotation of a device.

FIG. 6 illustrates an exemplary process of driving speakers in a rotating array, or a fixed array associated with a rotated display surface. The signals L and R are filtered 602 or otherwise processed to produce the bass signal B. Device rotation is detected; if available, the angle of rotation is detected 604, or predicted based upon certain factors, such as an elapsed time from commencement of rotation (e.g. in a certain direction from a certain starting angle) was detected. Bass B to the speakers is adjusted according to their actual or predicted horizontal alignment 606. Signals L and R to the speakers are also adjusted according to actual or predicted horizontal alignment 608. The exemplary description of the process thereby concludes 610.

Analysis

The bass signal B may be generated by filtering the original stereo signal. The bass is a lowpass filtered version of the average of the left and right stereo channels L and R. The channels L and R may be filtered so that the low-frequency signals on both channels are in phase, producing signals $L_H$ and $R_H$. This significantly reduces the power drain caused by out-of-phase bass signals, which can't be reproduced effectively by configurations such as the exemplary three and four speaker arrays described herein. The mono bass signal is described by $$B=\text{lowpass}((L+R)/2)$$

where L and R are the left and right stereo channel signals, respectively.

In one embodiment, the signal B is added to the output of each speaker. The speaker outputs are adjusted to become L+B, R+B, and 2B in both portrait and landscape orientations of the device. The amplifier inputs are continuously adjusted throughout the angle of rotation to provide consistent horizontal stereo sound. The system is therefore reproducing a total output of L+R+4B in all orientations, causing a pronounced frequency response rise at low frequencies, when all the speakers are working together. This rise may be equalized out.

A mathematical representation of such a system comprises three equations in four unknowns. One convenient approach to make the solution definite is to set the X amplifier output to equal −B. For the 'vertical' mapping (typically but not necessarily when the rectangular audio device is positioned in a portrait mode relative to the listener, see FIG. 1 view A):

$$W_v-X_v=R+B$$

$$Y_v-X_v=2B$$

$$Y_v-Z_v=L+B$$

Thus, $$X_v=-B;\ Y_v=B;\ W_v=R;\ Z_v=-L$$

The current output by each amplifier in the vertical configuration is given by:

$$IW_v=\frac{R+B}{d};\ IX_v=\frac{R+3B}{d};\ IY_v=\frac{L+3B}{d};\ IZ_v=\frac{L+B}{d}$$

The 'horizontal' mapping is employed when the speaker array is rotated 90° anticlockwise from the vertical position (see for example FIG. 1 view B):

$$W_h-X_h=L+B$$

$$Y_h-X_h=R+B$$

$$Y_h-Z_h=2B$$

Thus, $$X_h=-B;\ Y_h=R;\ W_h=L;\ Z_h=R-2B$$

The amplifier output currents in the horizontal configuration are given by:

$$IW_h=\frac{L+B}{d};\ IX_h=\frac{R+L+2B}{d};\ IY_h=\frac{R+3B}{d};\ IZ_h=\frac{2B}{d}$$

Although vertical may typically represent portrait mode relative to a listener, and horizontal may represent landscape mode, this choice is merely by convention. Vertical and horizontal are any positions in which the speaker array is rotated 90 from 'vertical' to 'horizontal'. In light of this description, it will be readily apparent to those skilled in the art how the signal mapping may be adjusted for rotations throughout 360 degrees, beyond the 90 degree anticlockwise rotation described to illustrate the above example.

At low frequencies, the signals R and L both approach the frequency of signal B. Thus the absolute value of currents IW and IZ tend to −2B/d in both cases, while the IX and IY currents tend to twice that, 4B/d, confirming that the central amplifiers are loaded twice as heavily. The system thermal design can account for this condition.

Smooth Fading Between Channels

The mapping between the system input signals and the amplifier output signals changes as the speaker array is rotated. An audio signal processor may be used to implement this mapping function. The mapping function may predict an angle of rotation based upon other factors, such as elapsed time of rotation, expected time of rotation (e.g., 500 ms), starting angle, and so on. A parameter α may be adjusted in fine increments from 0 to 1 over a period of time estimated to be the time it takes to rotate the device a certain amount (e.g., 90 degrees). In some embodiments a linear adjustment of a over the estimated rotation time interval may be suitable for defining the transition from portrait to landscape orientations and back again. More sophisticated, nonlinear mapping schemes may also be employed to account for device inertia. Below are exemplary mapping algorithms for the amplifier outputs in the four amplifier, three speaker embodiment illustrated in FIG. 3:

$$W_t=\alpha\cdot R+(1-\alpha)\cdot L$$

$$X_t=-B$$

$$Y_t=\alpha\cdot B+(1-\alpha)\cdot R$$

$$Z_t=-\alpha\cdot L+(1-\alpha)\cdot(R-2B)$$

An exemplary mapping algorithm for the three amplifier, three speaker embodiment illustrated in FIG. 4 is provided below:

$$W_t=-\alpha B+(1-\alpha)L$$

$$X_t=\alpha L+(1-\alpha)R$$

$$Y_t=\alpha R+(1-\alpha)B$$

Further Design Considerations

Certain embodiments may perform the channel mapping at the audio signal sample rate, and communicate the audio signals over a digital audio interface. A PSOC implementation may perform the initial upsampling and quantization on the L, R and B signals, with amplification provided by logic embodied by a discrete (separately packaged) amplifier chip. Interpolation may be performed directly on the quantized signals, requantizing them to fit the resolution of a PWM (pulse width modulation) output stage. This results in a rise in quantization distortion during the rotation interval. But rotation typically only takes a fraction of a second, and the distortion should be inaudible.

All power amplifiers have a finite, but low, output impedance. Open loop digital amplifiers have a higher output impedance than closed loop designs, of the order of 0.1-0.2 ohms at operational power levels. The output filter contributes additional impedance that is frequency-dependent.

In FIG. 3, the middle two amplifiers (X and Y) each feed two speakers. These same two speakers have other terminals being driven by signals from amplifiers W and Z. This causes a crosstalk effect. The effect is small and may be compensated for. When the speakers are sufficiently close together small crosstalk effects may be ignored.

The amplifier output filters should be designed to ensure that resonance is well controlled both for common mode and differential mode impedances. The output signal from amplifier X is always producing an output comprising exclusively low frequencies. It is therefore possible to connect a series RC filter to ground after the output inductor. This can be made with low enough high frequency impedance to serve as the main damping for all the common mode filter resonances. If necessary, the output filter network can be 'tuned' with smaller networks on the other outputs. Output filter design is less critical in systems where there's no external speaker connection, because EMI issues are much less likely than when long external speaker cables carry the noisy amplifier signals. Of course, it will be acceptable to use the standard output filter designs from the amplifier vendors but these designs may contain more components than are really needed. This takes up more space and money.

The use of highpass filters on L and R signals may result in a waste of amplifier output level, because the peak level of some signals is increased by the filtering, even though low frequency signals are being removed. An exemplary filter embodiment will now be described, although there are many alternatives that could also be employed toward the same results.

Some embodiments may employ a filter comprising a $2_{nd}$ order Linkwitz-Riley transfer function; the second order denominator may implement a Q of about 0.5. This section can conveniently be implemented with two cascaded first order sections. This filtering approach is more tolerant of quantization noise in the filter structure than an equivalent direct from biquad implementation.

Each input signal may be scaled by two different factors to provide inputs into respectively the highpass filter block and the summing stage that forms the first half of the mono bass block. The second scaling factor is 0.25 and this can be achieved with a 2-bit right shift of the data.

A cascade of two direct form first order highpass filters delivers the highpass signal directly for each channel. A middle delay element may be shared between the output of the first section and the input of the second section, for greater implementation efficiency.

A highpass filter implemented in this way may have a gain of slightly greater than unity at the relevant audio frequencies, which may be accounted for by making a small adjustment to the default scaling factor for the mono bass channel.

The output from a first highpass filter section on each channel may be fed directly to a mono bass summer. The output from this summer is the mono input signal filtered with one first order section, because subtracting a $1_{st}$ order highpass filter from unity yields a $1_{st}$ order lowpass filter. This signal is fed to a second lowpass filter section. The second section is implemented with separate additional scaling factors in the direct and delayed paths, again to make maximum use of the relatively restricted dynamic range of an available signal processor. The scaling factor may be adjusted away from its nominal value to implement a form of bass tone control acting at frequencies below the defined crossover frequency.

The coefficients $A_{11}$ through $A_{13}$ should be stored in different DFB memory locations, but under normal circumstances they'll be set to the same value. Actual coefficient, gain, and delay values will vary with implementation but are readily determined by those skilled in the art according to the needs of the particular application The result of the filtering is to convert the incoming stereo audio into the three signals ($L_H$, $R_H$, B) that are used in the rotation calculations. The H subscript on L and R indicates they are high pass filtered versions of the raw (source) stereo inputs L and R.

Implementations and Alternatives

Those having skill in the art will appreciate that there are various logic implementations by which processes and/or systems described herein can be effected (e.g., hardware, software, and/or firmware), and that the preferred vehicle will vary with the context in which the processes are deployed. "Software" refers to logic that may be readily readapted to different purposes (e.g. read/write volatile or nonvolatile memory or media). "Firmware" refers to logic embodied as read-only memories and/or media. Hardware refers to logic embodied as analog and/or digital circuits. If an implementer determines that speed and accuracy are paramount, the implementer may opt for a hardware and/or firmware vehicle; alternatively, if flexibility is paramount, the implementer may opt for a solely software implementation; or, yet again alternatively, the implementer may opt for some combination of hardware, software, and/or firmware. Hence, there are several possible vehicles by which the processes described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. Those skilled in the art will recognize that optical aspects of implementations may involve optically-oriented hardware, software, and or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood as notorious by those within the art that each function and/or operation within such block diagrams, flowcharts, or examples can be implemented, individually and/or collectively, by a wide range of hardware, software, firmware, or virtually any combination thereof. Several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in standard integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and/or firmware would be well within the skill of one of skill in the art in light of this disclosure. In addition, those skilled in the art will appreciate that the mechanisms of the subject matter described herein are capable of being distributed as a program product in a variety of forms, and that an illustrative embodiment of the subject matter described herein applies equally regardless of the particular type of signal bearing media used to actually carry out the distribution. Examples of a signal bearing media include, but are not limited to, the following: recordable type media such as floppy disks, hard disk drives, CD ROMs, digital tape, and computer memory.

In a general sense, those skilled in the art will recognize that the various aspects described herein which can be implemented, individually and/or collectively, by a wide range of hardware, software, firmware, or any combination thereof can be viewed as being composed of various types of "circuitry." Consequently, as used herein "circuitry" includes, but is not limited to, electrical circuitry having at least one discrete electrical circuit, electrical circuitry having at least one integrated circuit, electrical circuitry having at least one application specific integrated circuit, circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), circuitry forming a memory device (e.g., forms of random access memory), and/or circuitry forming a communications device (e.g., a modem, communications switch, or optical-electrical equipment).

Those skilled in the art will recognize that it is common within the art to describe devices and/or processes in the fashion set forth herein, and thereafter use standard engineering practices to integrate such described devices and/or processes into larger systems. That is, at least a portion of the devices and/or processes described herein can be integrated into a network processing system via a reasonable amount of experimentation.

The foregoing described aspects depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

What is claimed is:

1. A device comprising:

a speaker array comprising three or more speakers configured to produce stereo sound based on left and right stereo signal channels L and R, respectively;

logic to derive a low frequency bass signal, B from L and R;

logic to increase a level of signal B and decrease a level of L or R output by a first speaker of the speaker array as the first speaker is rotated through 90 degrees by way of a rotation of the device between a first and second orientations, and to increase a level of L or R and decrease a level of B output by at least a second speaker of the speaker array throughout the rotation.

2. The device of claim 1, further comprising:

logic to apply the signal B to every speaker of the array regardless of the orientation of the device.

3. The device of claim 1, comprising exactly three speakers driven by four amplifiers.

4. The device of claim 3, configured with logic that in portrait and landscape orientations provides one of the three speakers with a signal R+B, another of the three speakers with a signal L+B, and yet another of the three speakers with a signal 2B.

5. The device of claim 3, configured so that in either a portrait or landscape orientations, one of the three speakers receives a signal R, another of the three speakers receives L, and yet another of the three speakers receives B.

6. The device of claim 3, comprising logic to apply a continuous adjustment of the output of one of the speakers from B to R or from B to L as the device is rotated between the first and second orientations.

7. The device of claim 3, comprising exactly four amplifiers and exactly three speakers, wherein two of the four amplifiers are coupled to exactly two speakers apiece, and a different two of the four amplifiers are coupled to exactly one speaker apiece.

8. The device of claim 1, comprising logic to apply a continuous adjustment from R to L of the output of one of the speakers as the device is rotated between the first and second orientations.

9. The device of claim 1, the device being a visual display coupled to the speaker array via a docking platform, configured so that the display rotates and the speaker array remains in a fixed orientation and the horizontal alignment of various speakers in the array is a virtual property determined from the rotational angle of the visual display.

10. The device of claim 1, wherein all speakers of the speaker array are full range speakers.

11. An audio circuit, comprising:

stereo left and right channel inputs L and R, respectively;

at least three amplifier outputs; and logic to adjust one or more of the amplifier outputs from primarily full range outputs to primarily bass outputs and vice versa according to a parameter representing a degree of rotation of at least three speakers.

12. The circuit of claim 11, further comprising logic to adjust the amplifier outputs as a function of a degree of horizontal alignment associated with the at least three speakers.

13. The circuit of claim 11, comprising exactly four amplifiers configured to provide output signals to exactly three speakers.

14. The circuit of claim 11, further comprising logic to adjust the parameter representing the degree of rotation according to an elapsed time from when a beginning of rotation of the at least three speakers is first detected.

15. A process comprising:

providing left and right stereo channels L and R, respectively to a first set of two or more speakers of a speaker array, the speaker array configured to provide stereo sound using L and R;

applying a bass signal B to a second set of one or more speakers of the speaker array; and continuously decreasing the level of L or R applied to at least one speaker of the first set of speakers as the first set of speakers is rotated through 90 degrees; and continuously increasing the level of B applied to the at least one speaker of the first set of speakers as the first set of speakers is rotated through the 90 degrees.

16. The process of claim 15, further comprising:

continuously decreasing the level of B applied to at least one of the second set of speakers as the second set of speakers is rotated through the 90 degrees.

17. The process of claim 15, further comprising:

the total number of speakers in the array is three.

18. The process of claim 15, further comprising:

adjusting the application of L, R, and B to the first set and the second set as the speaker array is rotated so that in both of a portrait and landscape orientations, a first speaker of the speaker array receives L+B, a second speaker of the speaker array receives R+B, and a third speaker of the speaker array receives 2B.

19. The process of claim 15, further comprising:

adjusting the application of L, R, and B to the first set and the second set as the speaker array is rotated so that in both of a portrait and landscape orientations, a first speaker of the speaker array receives L, a second speaker of the speaker array receives R, and a third speaker of the speaker array receives B.

20. The process of claim 15, further comprising determining the amount of L, R, and B to apply in a digital oversampled domain.

21. The process of claim 15, further comprising:

determining the amount of L, R, and B to apply to particular speakers according to an angle of rotation of a visual display device coupled to the speaker array.

* * * * *